US007523989B2

(12) United States Patent
Wieland et al.

(10) Patent No.: US 7,523,989 B2
(45) Date of Patent: Apr. 28, 2009

(54) ARTICLE OF READY-TO-ASSEMBLE FURNITURE

(75) Inventors: Blaine L. Wieland, Spencerville, IN (US); Byron T. Shank, LaGrange, IN (US); Wesley S. Anspach, Fort Wayne, IN (US); Randolph Brown, Fort Wayne, IN (US)

(73) Assignee: Home Reserve, Inc., Fort Wayne, IN (US)

( * ) Notice: Subject to any disclaimer, the term of this patent is extended or adjusted under 35 U.S.C. 154(b) by 0 days.

(21) Appl. No.: 11/734,066

(22) Filed: Apr. 11, 2007

(65) Prior Publication Data

US 2008/0252130 A1 Oct. 16, 2008

(51) Int. Cl.
*A47C 7/16* (2006.01)
*A47C 15/00* (2006.01)
*A47C 7/62* (2006.01)

(52) U.S. Cl. ..... 297/440.13; 297/440.1; 297/440.14; 297/233; 297/248; 297/188.08; 297/188.09

(58) Field of Classification Search ..... 297/440.1, 297/440.14, 233, 248, 188.08, 188.09, 440.13, 297/188.1
See application file for complete search history.

(56) References Cited

U.S. PATENT DOCUMENTS 2,164,715 A * 7/1939 Krainbill ..... 297/440.14 X
4,602,817 A * 7/1986 Raftery ..... 297/440.1
4,848,839 A * 7/1989 Galardo ..... 297/440.1
5,314,234 A * 5/1994 England ..... 297/248
6,267,446 B1 7/2001 Wieland et al.
6,568,058 B1 5/2003 Wieland et al.
6,783,182 B1 * 8/2004 Gallagher ..... 297/440.14
6,981,747 B2 1/2006 Wieland et al.
7,044,557 B2 5/2006 Wieland
2002/0103716 A1 8/2002 Wieland et al.
2004/0095000 A1 * 5/2004 Durling ..... 297/188.2
2005/0006943 A1 * 1/2005 Wieland ..... 297/440.13

* cited by examiner

*Primary Examiner*—Rodney B White
(74) *Attorney, Agent, or Firm*—Baker & Daniels LLP

(57) ABSTRACT

A corner unit for an article of sectional furniture. In an exemplary embodiment, the corner unit includes a frame having a plurality of frame members. The frame may include two internal frame members which are disposed substantially perpendicular to each other. The internal frame members provide rigidity and strength to the frame without requiring other angled cuts and connections for the frame. The frame may also include a cover assembly which provides a seat and at least one storage compartment. The frame members may be interconnected by interlocking protrusions and cutout portions, as well as by threaded fasteners received in push-in connector elements which are held in recesses within the frame members.

20 Claims, 18 Drawing Sheets

42
42
42
40
40
34c
48
34
36
38,38a
42
34a
38,38b
2
44
44
42
42
34h
7
34f
36
8
34d
42
3
44
34b
4
38,38a
34i
42
11
34g
5
34e
6
34j
12
34k
13
38,38b
38,38a

ARTICLE OF READY-TO-ASSEMBLE FURNITURE

BACKGROUND

1. Field of the Disclosure

The present disclosure relates generally to custom ordered furniture and the construction and packaging of such furniture for shipment and storage. More particularly, the disclosure relates to fully upholstered, ready-to-assemble furniture which may be custom ordered by a consumer, packaged by the seller for shipment to the consumer by a parcel delivery service, and then assembled by the consumer from the packaged components.

2. Description of the Related Art

Ready-to-assemble furniture is furniture which is packaged for shipment and storage in disassembled form, with assembly to be done by the consumer or end user. Examples of existing ready-to-assemble non-upholstered furniture include bookcases, television stands, and simple chairs and benches. Mass merchandized, ready-to-assemble furniture is expected to be rather less expensive to the consumer than comparable pre-assembled furniture or to have distinctive functional features generally not available with its pre-assembled counterpart.

The genre of ready-to-assemble furniture packaged for mass merchandizing sale and home delivery has generally been limited to pieces of furniture which are utilitarian or hard-surfaced. As such, prior ready-to-assemble furniture does not satisfy the need for primary pieces of fully upholstered furniture which may be custom ordered by the consumer, and either delivered to the household of the consumer by a parcel delivery service, or taken home by the consumer from a retail location.

What is needed is ready-to-assemble furniture of high quality and stable construction which may be packaged in a compact, easily storable and transportable manner, for easy shipment via existing, non-particularized home delivery channels.

SUMMARY

The present disclosure provides a corner unit for an article of sectional furniture. In an exemplary embodiment, the corner unit includes a frame having a plurality of frame members. The frame may include two internal frame members which are disposed substantially perpendicular to each other. The internal frame members provide rigidity and strength to the frame without requiring other angled cuts and connections for the frame. The frame may also include a cover assembly which provides a seat and at least one storage compartment. The frame members may be interconnected by interlocking protrusions and cutout portions, as well as by threaded fasteners received in push-in connector elements which are held in recesses within the frame members.

In one form thereof, the present disclosure provides a corner unit for an article of sectional furniture, including at least a first internal frame member and a second internal frame member disposed substantially perpendicular with respect to each other; at least a first sectional facing frame member and a second sectional facing frame member, said sectional facing frame members respectively connected to said first internal frame member and said second internal frame member; and a first backrest frame member and a second backrest frame member, said first and second backrest frame members at least partially defining a backrest, said first and second backrest frame members respectively connected to said first internal frame member and said second internal frame member.

In another form thereof, the present disclosure provides a corner unit for an article of sectional furniture, including a backrest portion; a seating portion; and at least a first internal frame member and a second internal frame member each defining at least a portion of said seating portion and said backrest portion, said first internal frame member and said second internal frame member disposed in overlapping relationship and substantially perpendicular with respect to each other.

In yet another form thereof, the present disclosure provides a corner unit for an article of sectional furniture, the corner unit including a sectional facing portion and a backrest portion, including a storage area defined by a plurality of interconnected frame members having upper edges; and a cover assembly supported by said upper edges, said cover assembly defining at least two diverging planar seating surfaces.

BRIEF DESCRIPTION OF THE DRAWINGS

The above-mentioned and other features of the disclosure, and the manner of attaining them, will become more apparent and will be better understood by reference to the following description of embodiments of the disclosure taken in conjunction with the accompanying drawings, wherein.

Corresponding reference characters indicate corresponding parts throughout the several views. The exemplifications set out herein illustrate embodiments of the disclosure and such exemplifications are not to be construed as limiting the scope of the invention in any manner.

DETAILED DESCRIPTION

Except as described below, article of furniture 30 includes many features similar to the articles of furniture described in U.S. Pat. No. 7,044,557, entitled ARTICLE OF READY-TO-ASSEMBLE FURNITURE; U.S. Pat. No. 6,981,747, entitled FULLY UPHOLSTERED, READY-TO-ASSEMBLE ARTICLE OF FURNITURE; U.S. Pat. No. 6,568,058, entitled METHOD OF ASSEMBLING A FULLY UPHOLSTERED READY-TO-ASSEMBLE ARTICLE OF FURNITURE; and U.S. Pat. No. 6,267,446, entitled COMPRESSED UPHOLSTERED FURNITURE ASSEMBLY KIT AND METHOD OF MANUFACTURE, all of which are assigned to the assignee of the present disclosure, the disclosures of which are expressly incorporated herein by reference.

Figure 1:
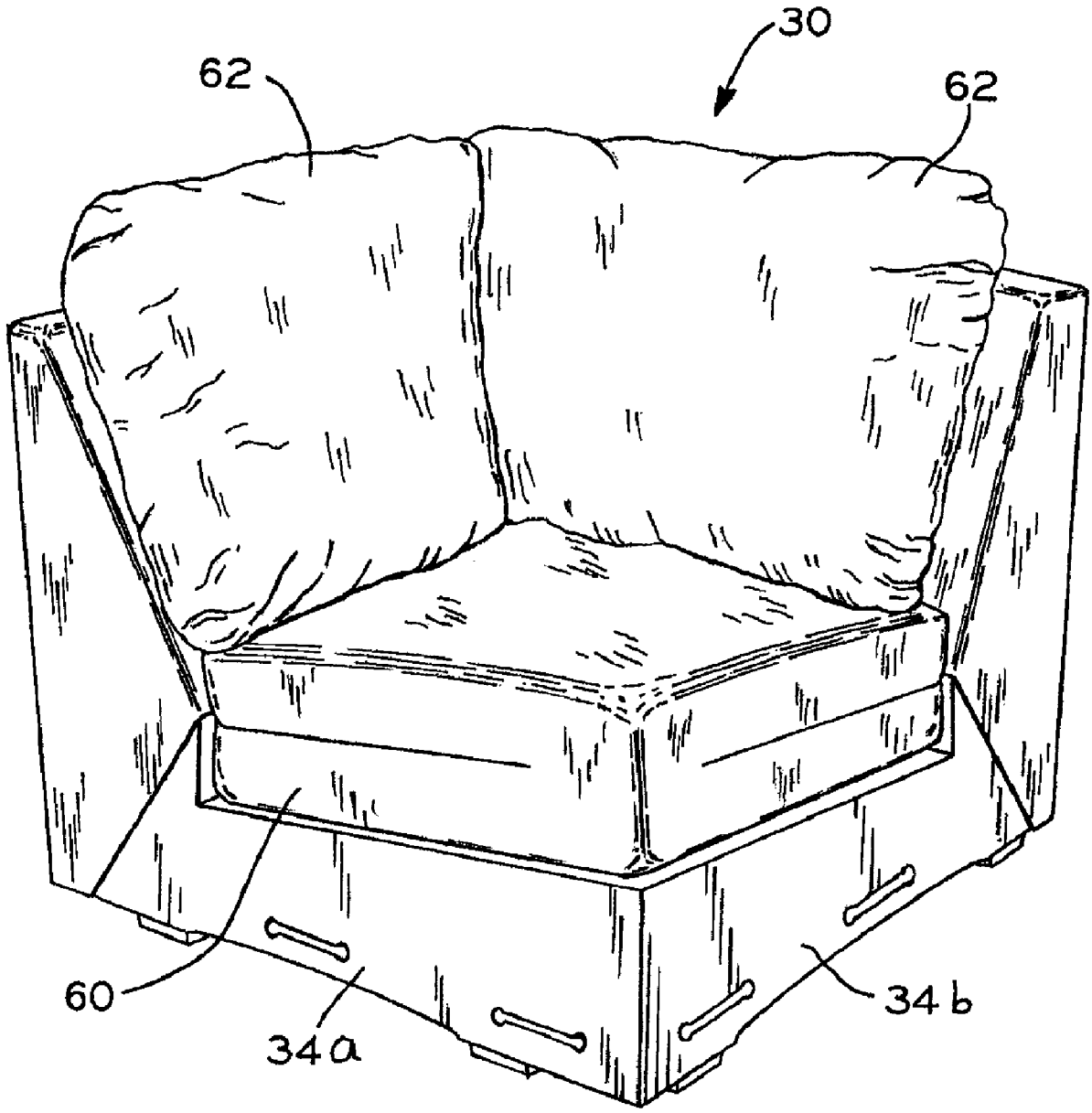
FIG. 1 is a perspective view of an exemplary article of furniture according to one embodiment of the present disclosure, shown as a sectional corner unit.

Referring now to FIG. 1, article of furniture 30 is shown and may be formed as a sectional corner unit. Article of furniture 30 may be a portion of sectional sofa unit 31, shown in FIG. 2, which may include other sectional units 64*a*, 64*b*.

Figure 3:
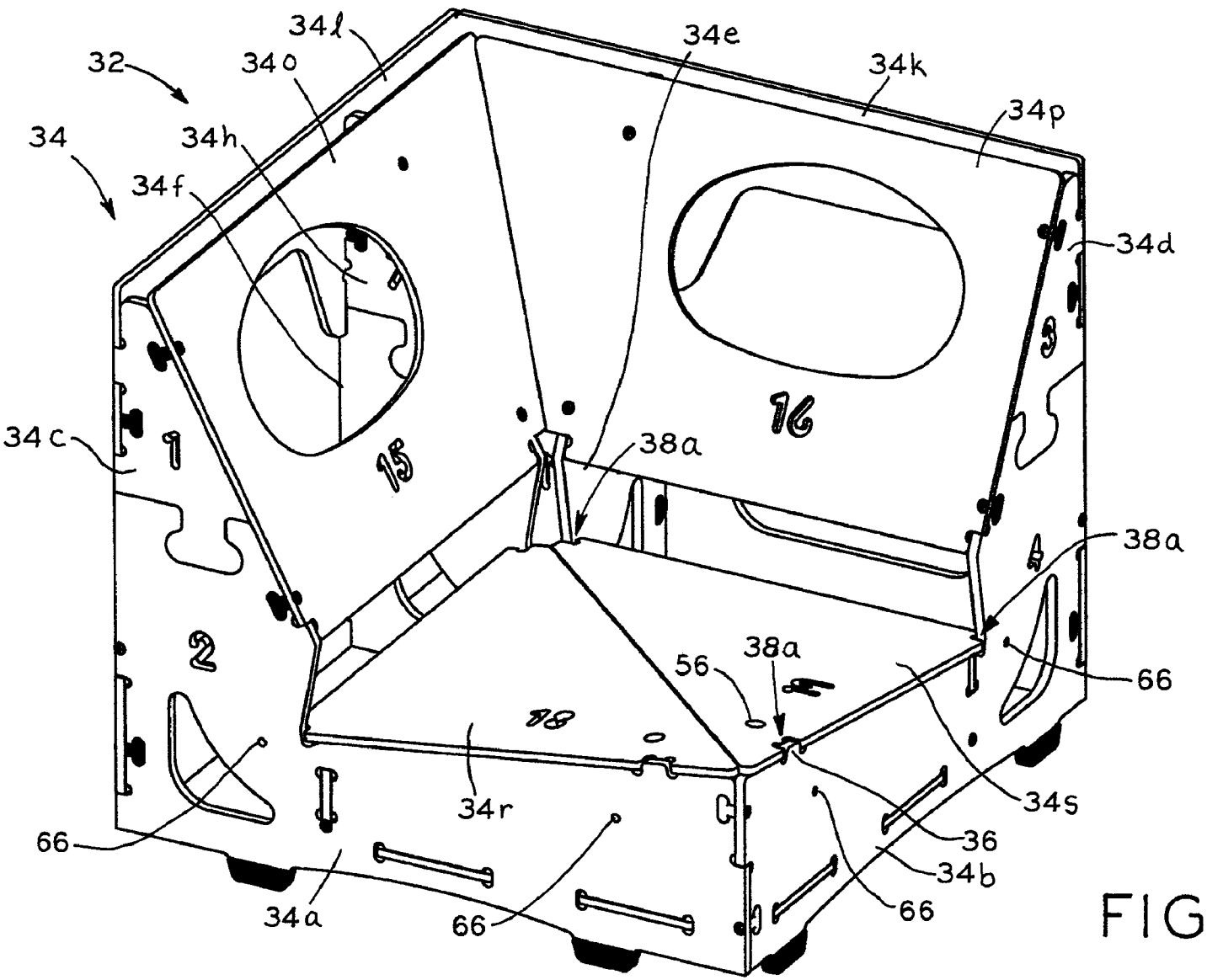
FIG. 3 is a front perspective view of the assembled frame of the sectional corner unit of FIG. 1.

Referring now to FIG. 3, article of furniture 30 may include frame 32 having a plurality of individual frame members 34 which are assembled together to form frame 32.

Figure 4:
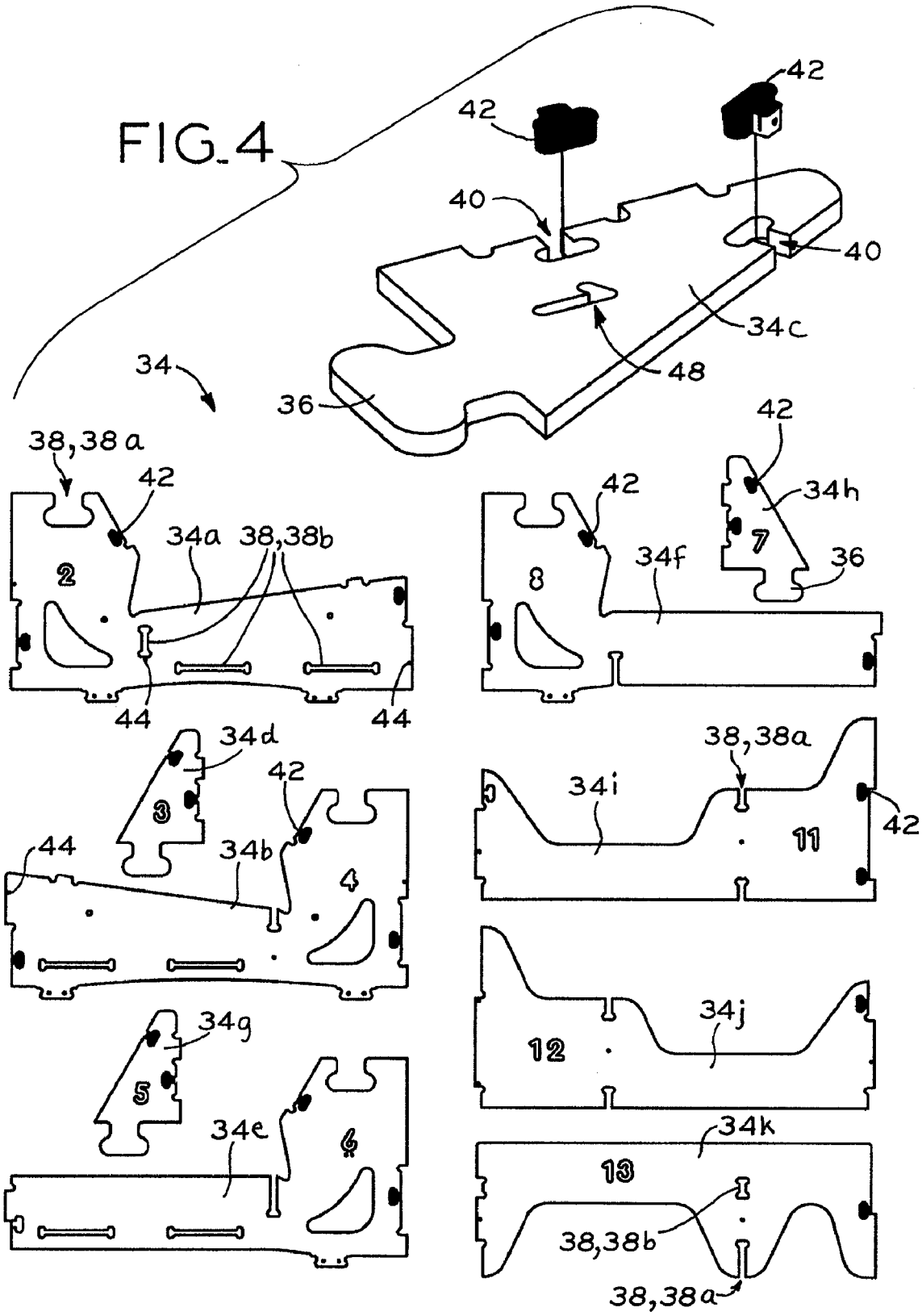
FIG. 4 is a view of a plurality of frame members of the frame of FIG. 3.

As shown in FIG. 4, frame members 34 generally may include lower front or sectional facing panels 34*a*, 34*b*, upper front or sectional facing panels 34*c*, 34*d*, lower intermediate panels 34*e*, 34*f*, upper intermediate panels 34*g*, 34*h*, lower rear panels 34*i*, 34*j*, upper rear panels 34*k*, 34*l* (FIG. 14), base panels 34*m* (FIG. 9A), 34*n* (FIG. 9A), backrest panels 34*o* (FIG. 15), 34*p* (FIG. 16), support panel 34*q* (FIG. 17A), and seat panels 34*r* (FIG. 18), 34*s* (FIG. 3).

Frame members 34 may also include projections 36 and cutout portions 38, which are insertable into one another to connect adjacent frame members 34. As shown with reference to upper front panel 34*c* in FIG. 4, for example, cutout portions 38 may include slots 38*a* and apertures 38*b*. For securing adjacent frame members 34, recesses 40 are provided and are adapted to receive push-in connector elements 42. Frame members 34 may also include apertures 44 which receive fasteners 46 (FIG. 7, for example) cooperating with connector fastener holes 43 (FIG. 5, for example) of push-in connector elements 42, as described below. As described in detail in the above-incorporated U.S. Pat. No. 6,568,058, push-in connector elements 42 may be formed of any suitable plastic and may receive fasteners 46 in connector fastener holes 43. Push-in connector elements 42 provide secure connections between frame members 34 when a fastener 46 is inserted through aperture 44 in a frame member 34 and tapped or screwed into connector fastener hole 43 of push-in connector element 42. Each frame member 34 may include number cutout 48. The numbering of frame members 34 eases assembly of frame 32 by allowing individual frame members 34 to be identified and referred to in a set of printed assembly instructions, for example. Number cutouts 48 are unrelated to the reference numerals used in the present disclosure.

Figure 5:
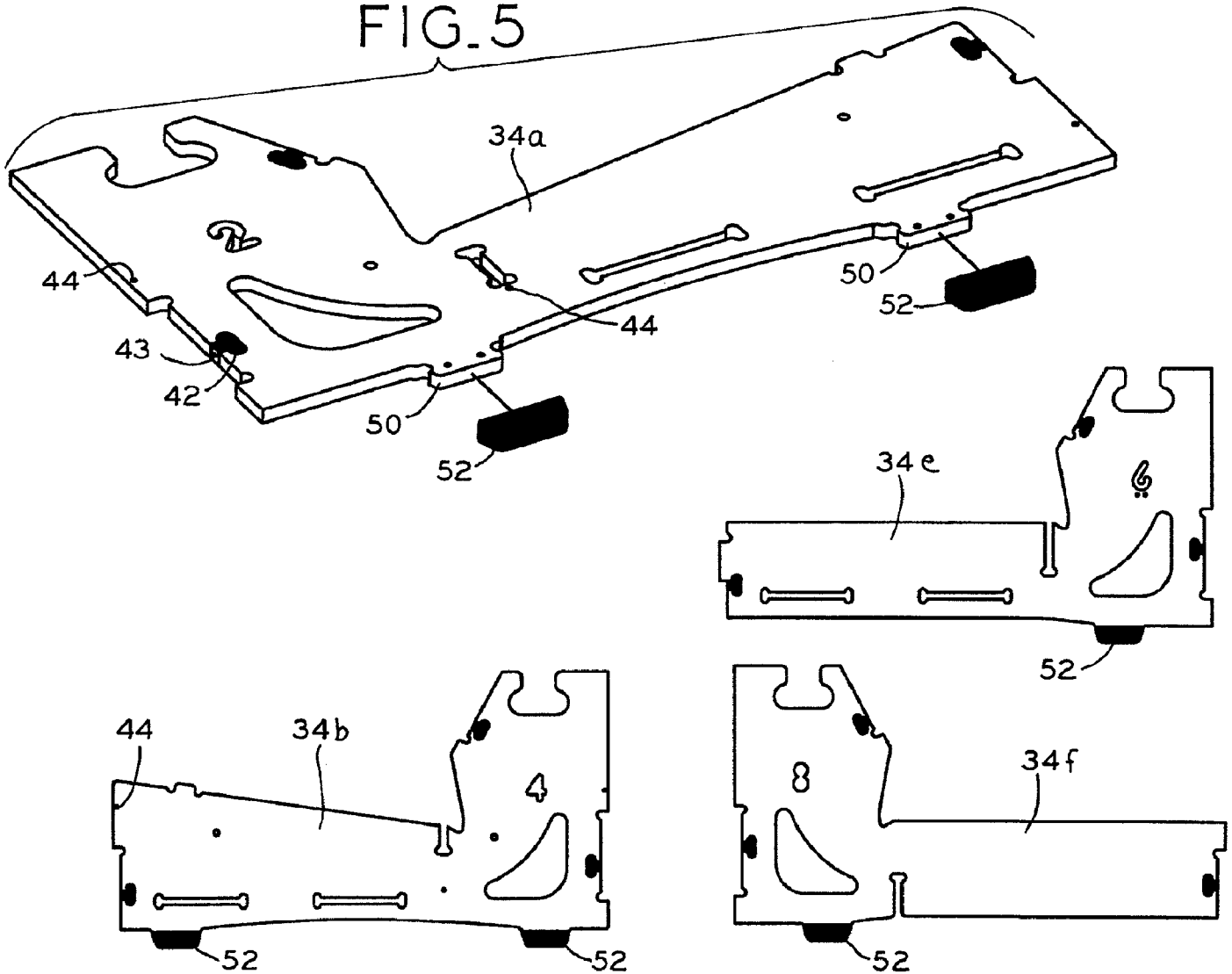
FIG. 5 is another view of a plurality of frame members of the frame of FIG. 3, showing the attachment of foot caps to the feet of the frame members.

Referring now to FIG. 5, an initial step of the assembly process involves attaching foot caps to a selected portion of the frame members. Some frame members 34, such as lower front panels 34*a*, 34*b* and lower intermediate panels 34*e*, 34*f*, may include feet 50 which may each be covered by foot cap 52 which is pressed onto each foot 50. Foot caps 52 engage a floor surface to prevent frame 32 from sliding thereon, and to prevent frame 32 from scratching the floor surface. Foot caps 52 also serve as a protective "boot" to protect feet 50 from water or moisture, and to protect feet 50 from contact with other objects which may cause feet 50 to dent, flake, or delaminate.

Figure 6:
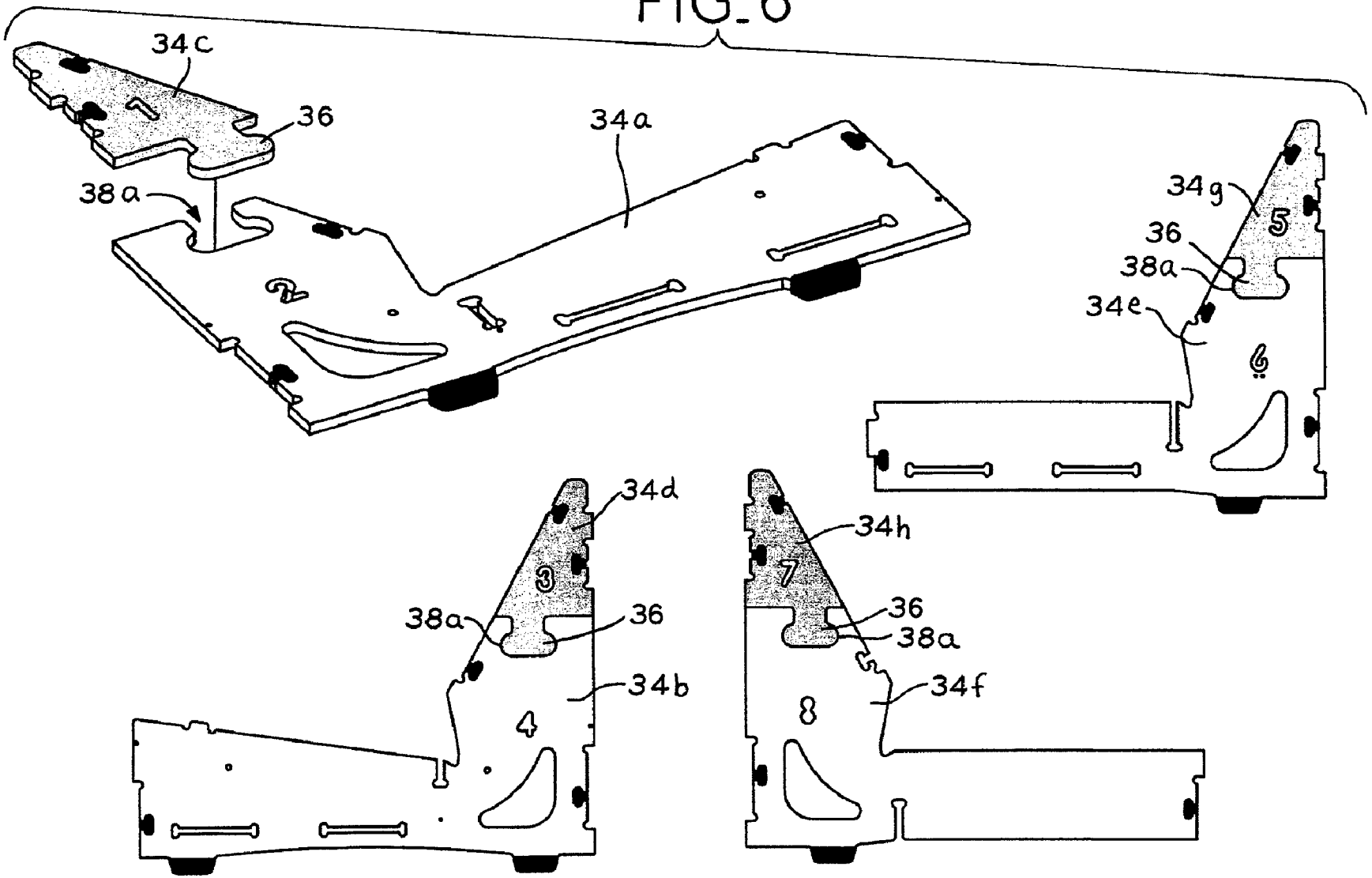
FIG. 6 is a partially exploded view of a plurality of frame members of the frame of FIG. 3, showing the attachment of individual frame members according to the initial assembly steps.

Referring to FIG. 6, the next step of the assembly process involves constructing the front, or sectional facing, and intermediate panels of frame 32. Each upper front panel 34*c*, 34*d* includes projection 36 and each lower front panel 34*a*, 34*b* includes slot 38*a*. Upper front panel 34*c* and lower front panel 34*a* are interlocked together by inserting projection 36 of upper front panel 34*c* into slot 38*a* of lower front panel 34*a*. Similarly, upper front panel 34*d* and lower front panel 34*b* are interlocked together by inserting projection 36 of upper front panel 34*d* into slot 38*a* of lower front panel 34*b*. Each upper intermediate panel 34*g*, 34*h* includes projection 36 and each lower intermediate panel 34*e*, 34*f* includes slot 38*a*. Upper intermediate panel 34*g* and lower intermediate panel 34*e* are interlocked together by inserting projection 36 of upper intermediate panel 34*g* into slot 38*a* of lower intermediate panel 34*e*. Similarly, upper intermediate panel 34*h* and lower intermediate panel 34*f* are interlocked together by inserting projection 36 of upper intermediate panel 34*h* into slot 38*a* of lower intermediate panel 34*f*.

Figure 7:
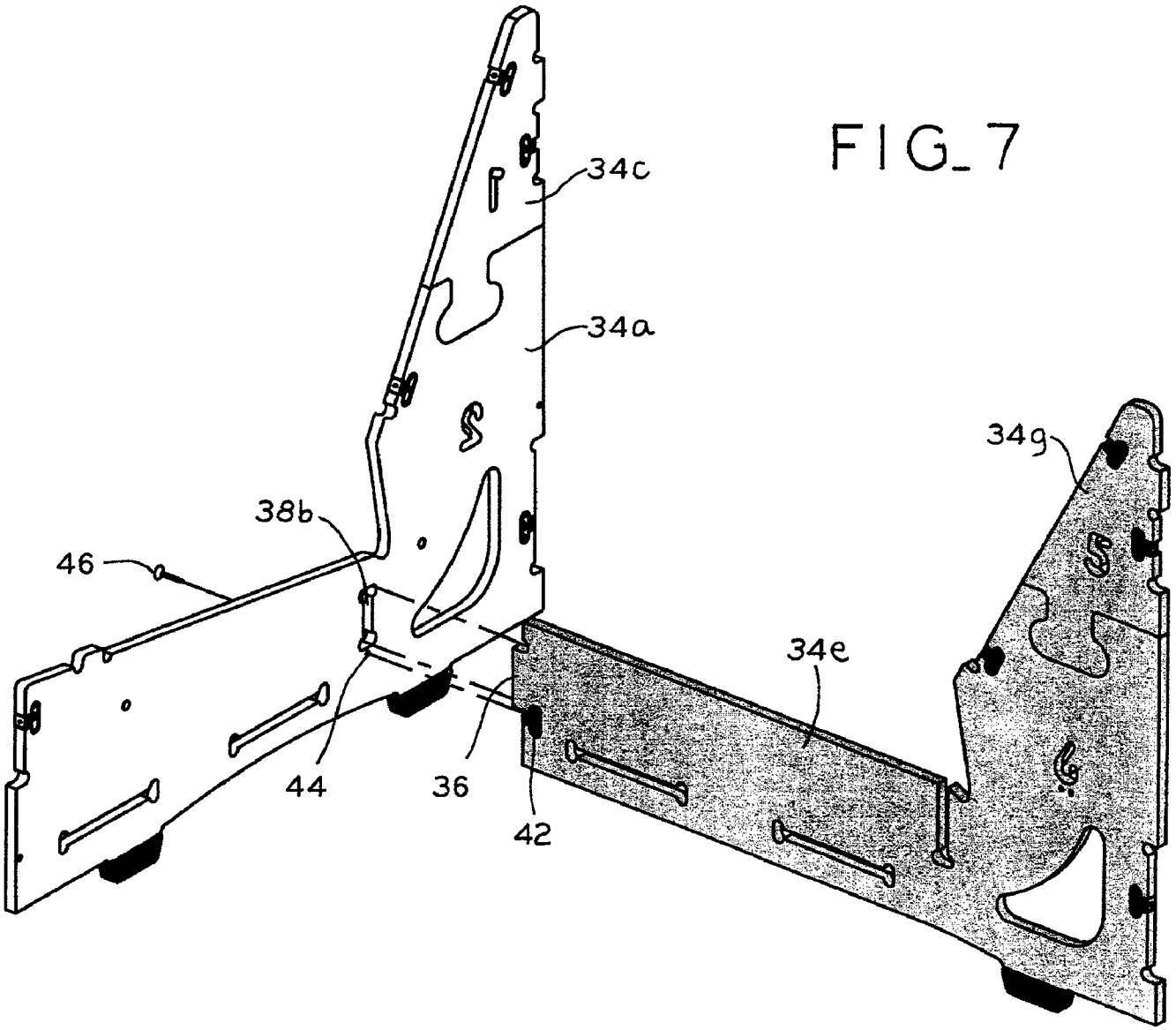
FIGS. 7, 8, 9A, 9B, 10, 11, 12, 13, 14, 15, 16, 17A, and 18 are exploded partial perspective views of portions of the frame of FIG. 3, showing the attachment of individual frame members according to the assembly steps.

Referring to FIG. 7, the next step of the assembly process involves interlocking one of the front panels with one of the intermediate panels. Lower front panel 34*a* includes aperture 38*b* and lower intermediate panel 34*e* includes projection 36. Lower intermediate panel 34*e* is interlockingly connected to lower front panel 34*a* by inserting projection 36 of lower intermediate panel 34*e* into aperture 38*b* of lower front panel 34*a*. Fastener 46 may be inserted through aperture 44 in lower front panel 34*a* and into connector fastener hole 43 (FIG. 5) of push-in connector element 42 in lower intermediate panel 34*e*.

Figure 8:
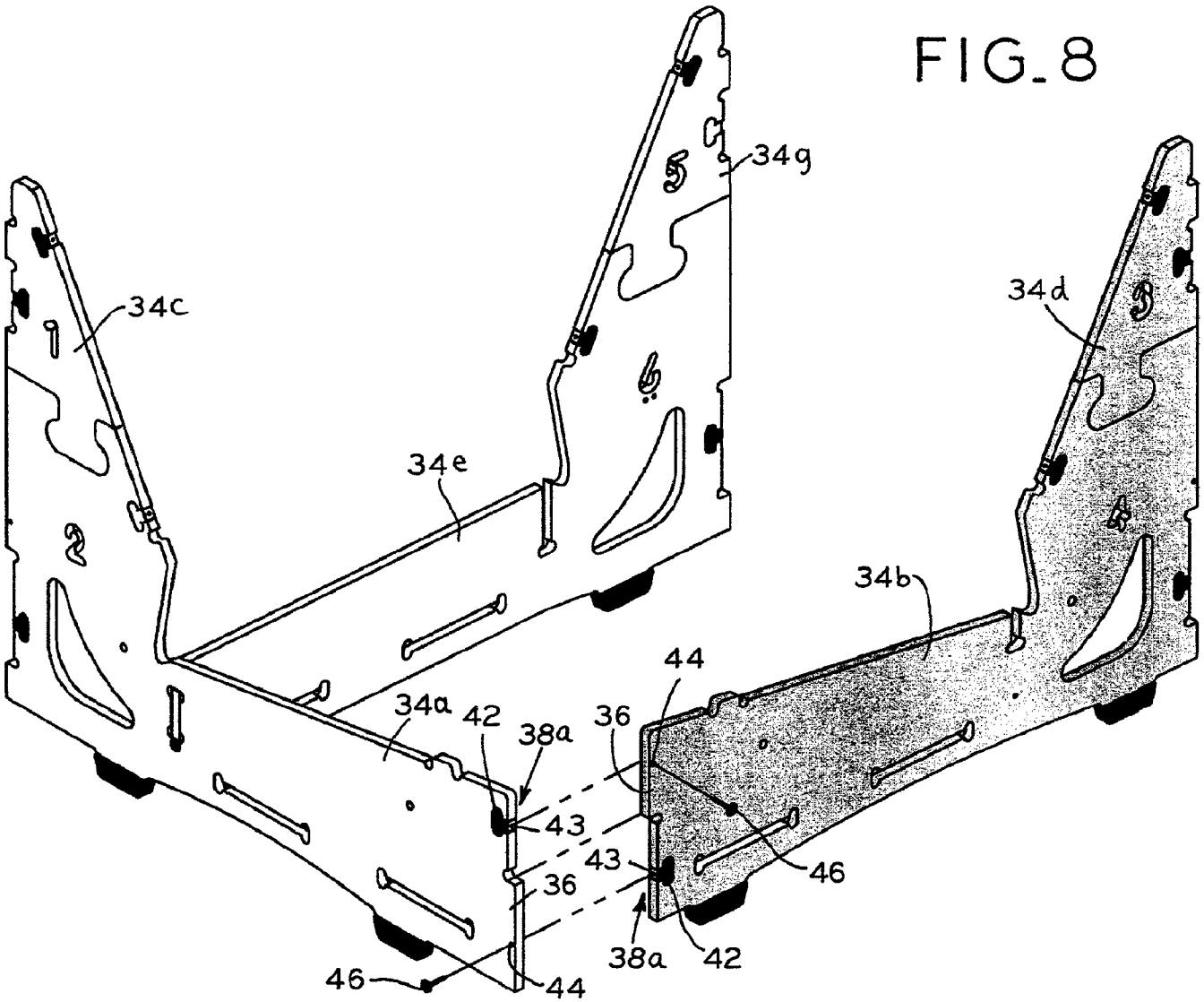

Referring to FIG. 8, the next step of the assembly process involves interlocking the two front panels. Lower front panel 34*a* includes slot 38*a* and projection 36 and lower front panel 34*b* includes slot 38*a* and projection 36. Lower front panel 34*a* is interlockingly connected to lower front panel 34*b* by inserting projection 36 of lower front panel 34*a* into slot 38*a* of lower front panel 34*b* and by inserting projection 36 of lower front panel 34*b* into slot 38*a* of lower front panel 34*a*. Fasteners 46 may be inserted through apertures 44 provided in each lower front panel 34*a*, 34*b* and into connector fastener holes 43 provided in respective push-in connector elements 42 in each lower front panel 34*b*, 34*a*.

Figure 9A:
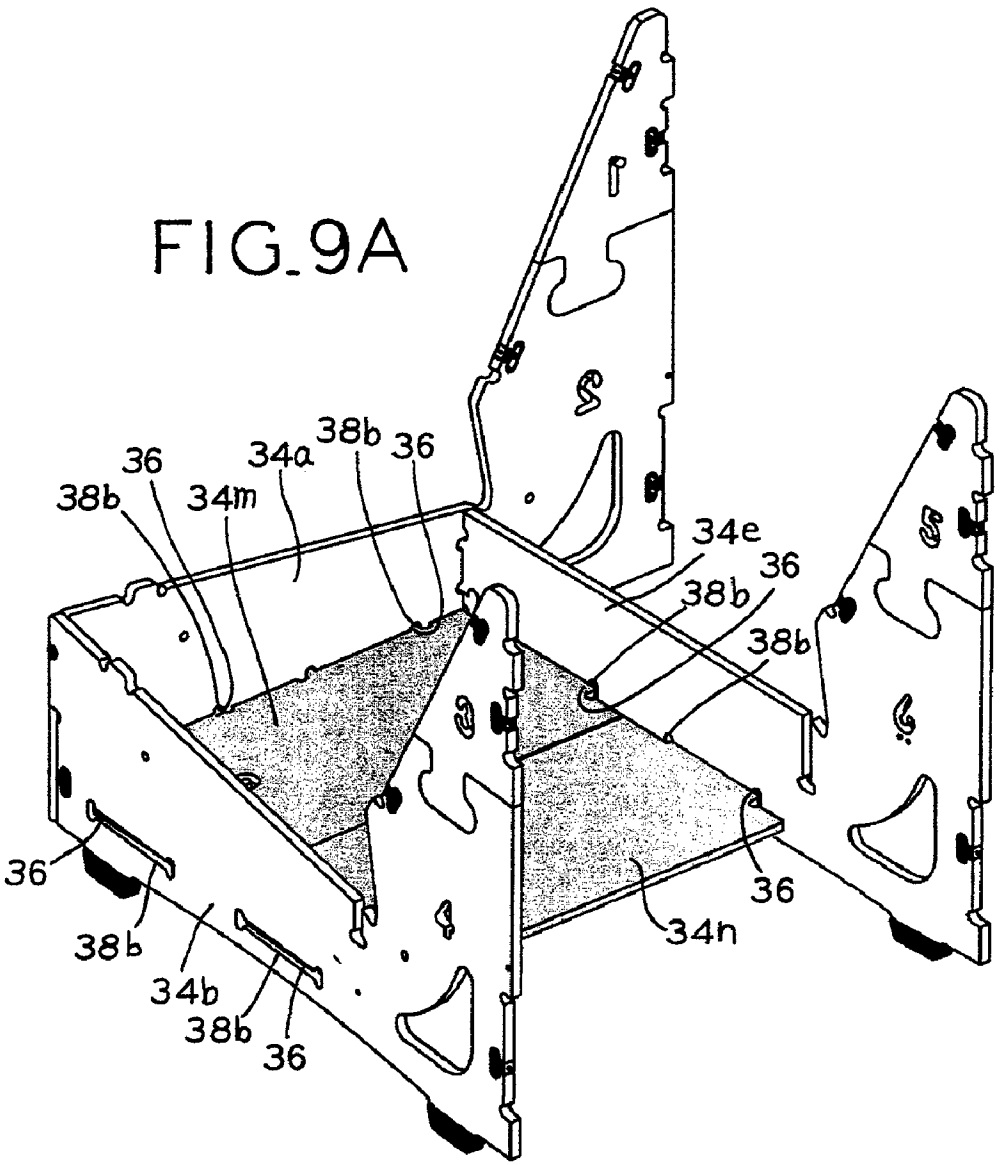
Figure 9B:
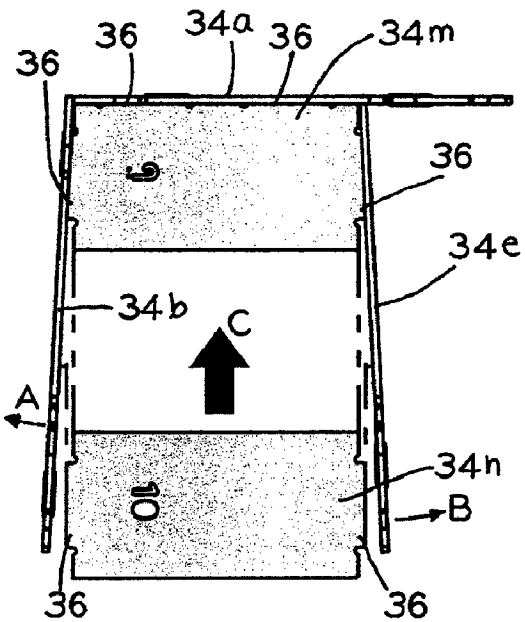

Referring to FIGS. 9A and 9B, the next step of the assembly process involves interlocking the base panels to the front panels and one of the intermediate panels. Each lower front panel 34*a*, 34*b* and lower intermediate panel 34*e* includes at least two apertures 38*b*. Each base panel 34*m*, 34*n* includes a plurality of projections 36. As shown in FIG. 9B, lower front panel 34*b* and lower intermediate panel 34*e* may be slightly moved away from each other while still maintaining the interlocking connections with lower front panel 34*a*, such as to facilitate insertion of base panels 34*m*, 34*n*. For example, lower front panel 34*b* is moved slightly in the general direction of arrow A in FIG. 9B and lower intermediate panel 34*e* is moved slightly in the general direction of arrow B in FIG. 9B. Such movement of panels 34*b*, 34*e* provides a clearance for insertion of base panels 34*m*, 34*n*, specifically, such movement of panels 34*b*, 34*e* allows passage of projections 36 of base panels 34*m*, 34*n* during movement of base panels 34*m*, 34*n* in the general direction of arrow C and insertion of projections 36 into corresponding apertures 38*b* in each lower front panel 34*a*, 34*b* and lower intermediate panel 34*e*.

Figure 10:
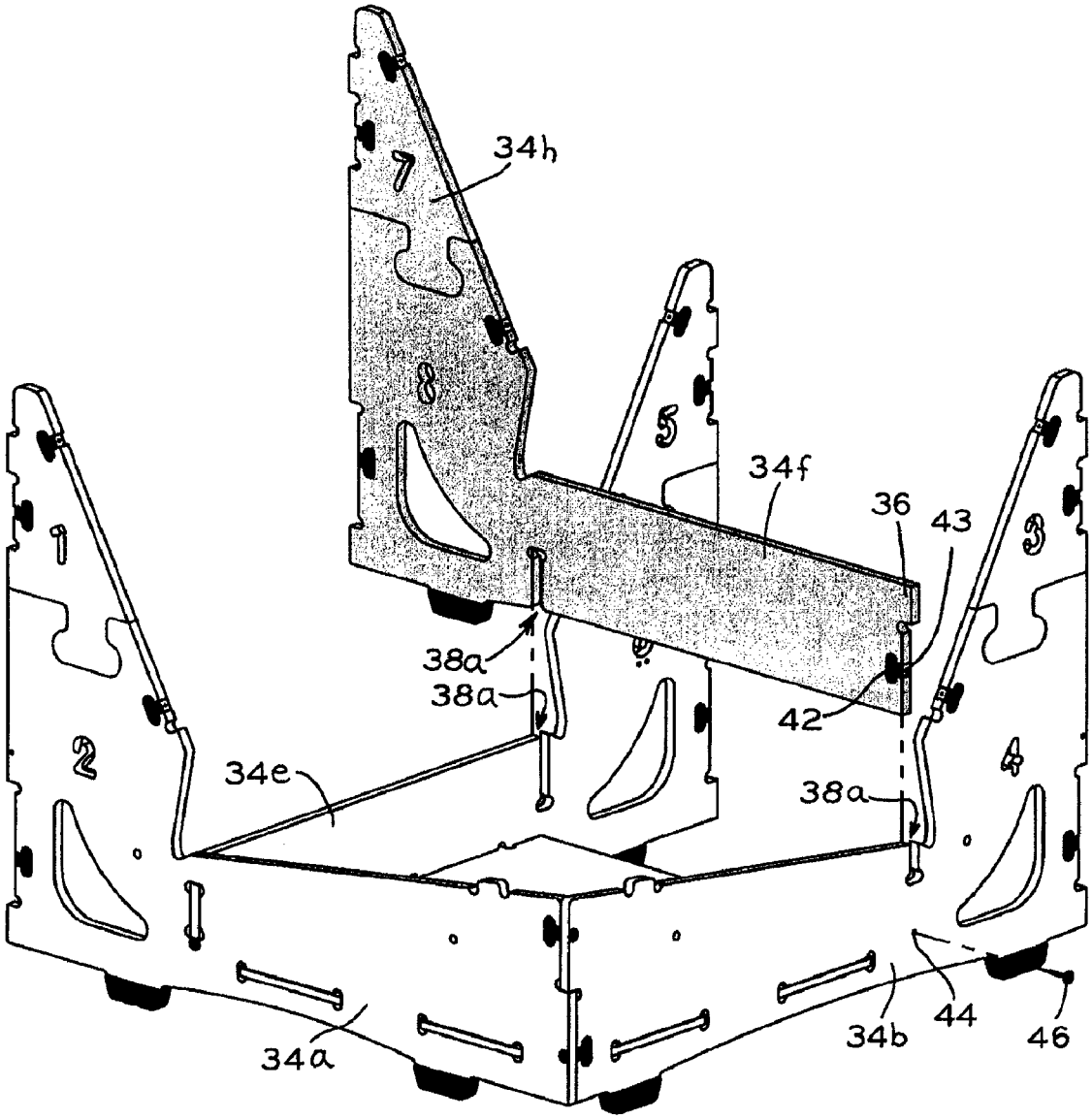

Referring to FIG. 10, the next step of the assembly process involves interlocking the other intermediate panel to the front panels and the first intermediate panel. Lower intermediate panel 34*e* includes slot 38*a*. Lower front panel 34*b* includes slot 38*a* and aperture 44. Lower intermediate panel 34*f* includes slot 38*a* and projection 36. Lower intermediate panel 34*f* is interlockingly connected to lower intermediate panel 34*e* by interlocking slot 38*a* of lower intermediate panel 34*f* with slot 38*a* of lower intermediate panel 34*e* (i.e., slot 38*a* of intermediate panel 34*e* slides through slot 38*a* of lower intermediate panel 34*f*, after which slot 38*a* of intermediate panel 34*e* engages lower intermediate panel 34*f* above slot 38*a* of lower intermediate panel 34*f* and slot 38*a* of intermediate panel 34*f* engages lower intermediate panel 34*e* below slot 38*a* of lower intermediate panel 34*e*) and by engaging projection 36 of lower intermediate panel 34*f* with slot 38*a* of lower front panel 34*b*. A portion of lower intermediate panel 34*e* extends rearwardly, i.e., away from the sectional facing portions of frame 32, of the interlocking connection with lower intermediate panel 34*f*. Similarly, a portion of lower intermediate panel 34*f* extends rearwardly of the interlocking connection with lower intermediate panel 34*e*. Such overlapping of lower intermediate panel 34*e* and lower intermediate panel 34*f* creates added stability for frame 32. Fastener 46 may be inserted through aperture 44 provided in lower front panel 34*b* and into connector fastener hole 43 in push-in connector element 42 disposed in lower intermediate panel 34*f*.

The partially assembled frame 32 shown in FIG. 10 is formed of four interlockingly engaged planar frame members 34 which are arranged at approximately 90° angles with respect to each other, i.e., lower front panel 34*a* forms an approximate 90° angle with lower front panel 34*b* and lower intermediate panel 34*e*, lower front panel 34*b* forms an approximate 90° angle with lower front panel 34*a* and lower intermediate panel 34*f*, lower intermediate panel 34*f* forms an approximate 90° angle with lower front panel 34*b* and lower intermediate panel 34*e*, and lower intermediate panel 34*e* forms an approximate 90° angle with lower front panel 34*a* and lower intermediate panel 34*f*. Advantageously, a 45° angled cut or intersection between these primary support frame members of frame 32 is not necessary; therefore, frame 32 is stronger and easier to assemble and manufacture than a frame requiring such frame members with 45° angled cuts and/or intersections.

Figure 11:
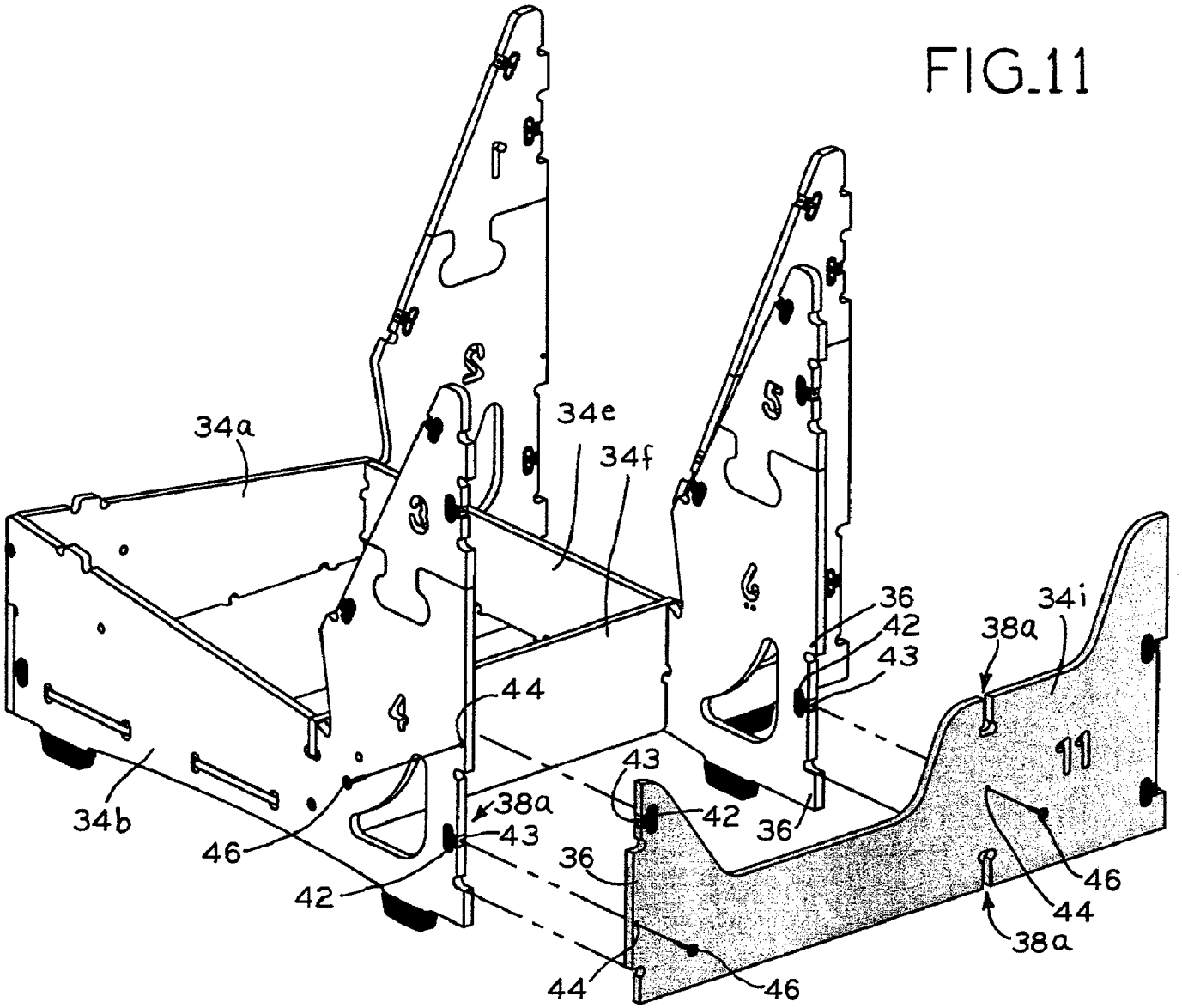

Referring to FIG. 11, the next step of the assembly process involves interlocking one of the lower rear panels to the remainder of the partially assembled frame. Lower front panel 34*b* may include slot 38*a* and aperture 44. Lower rear panel 34*i* may include projection 36 and aperture 44. Lower rear panel 34*i* is interlockingly connected to lower front panel 34*b* by engaging projection 36 of lower rear panel 34*i* with slot 38*a* of lower front panel 34*b*. Fastener 46 may be inserted through aperture 44 in lower rear panel 34*i* and into connector fastener hole 43 in push-in connector element 42 disposed in lower front panel 34*b*. Similarly, fastener 46 may be inserted through aperture 44 in lower front panel 34*b* and into connector fastener hole 43 in push-in connector element 42 disposed in lower rear panel 34*i*. Lower intermediate panel 34*e* may include projections 36 and lower rear panel 34*i* may include slots 38*a* and aperture 44. Lower rear panel 34*i* is interlockingly connected to lower intermediate panel 34*e* by engaging projections 36 of lower intermediate panel 34*e* into slots 38*a* in lower rear panel 34*i*. Fastener 46 may be inserted through aperture 44 in lower rear panel 34*i* and into connector fastener hole 43 in push-in connector element 42 disposed in lower intermediate panel 34*e*.

Figure 12:
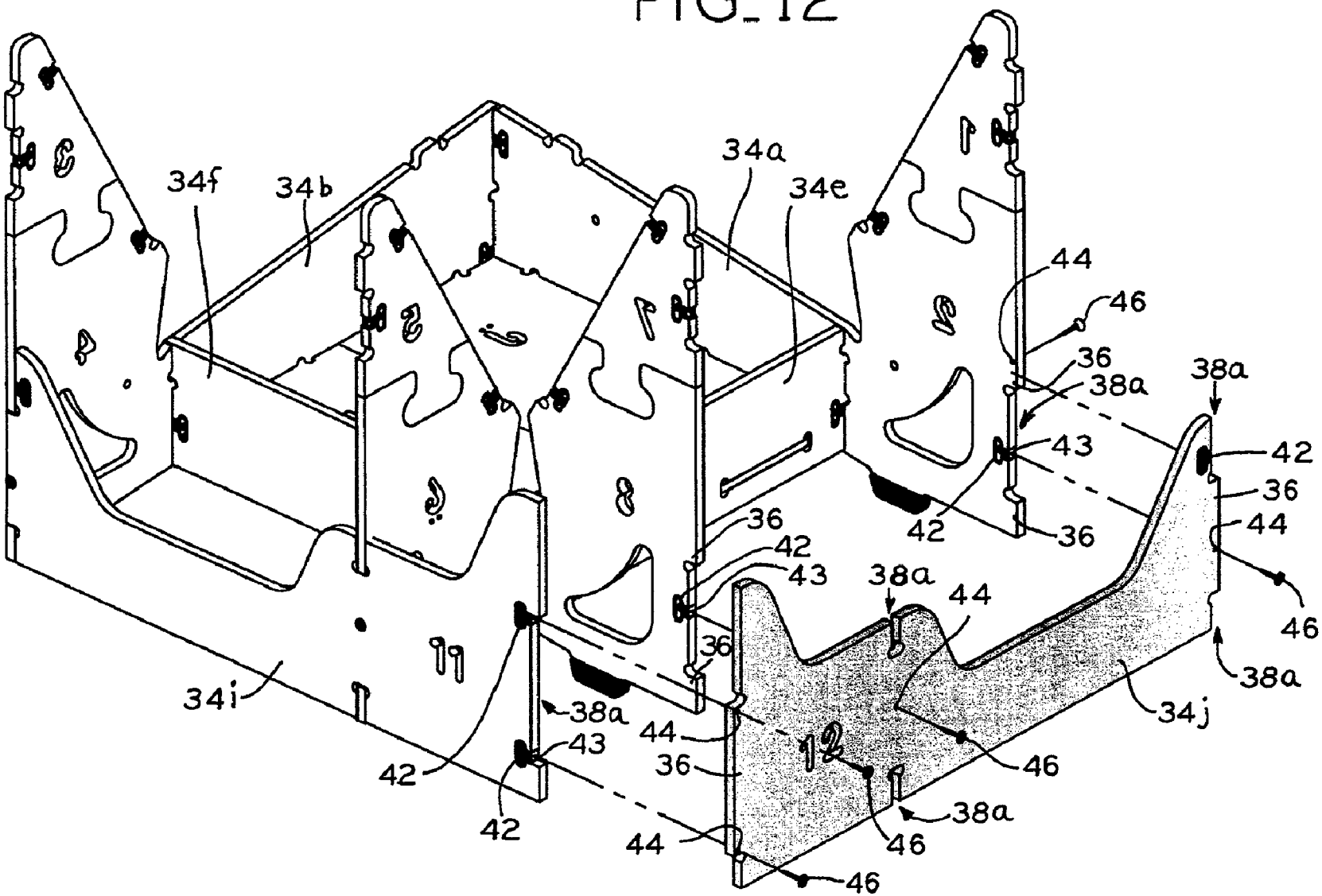

Referring to FIG. 12, the next step of the assembly process involves interlocking the other lower rear panel to the remainder of the partially assembled frame. Lower rear panel 34*i* may include slot 38*a* and lower rear panel 34*j* may include projection 36 and apertures 44. Lower rear panel 34*j* is interlockingly connected to lower rear panel 34*i* by engaging projection 36 of lower rear panel 34*j* into slot 38*a* of lower rear panel 34*i*. Fasteners 46 may be inserted through apertures 44 in lower rear panel 34*j* and into connector fastener holes 43 in push-in connector elements 42 disposed in lower rear panel 34*i*. Lower rear panel 34*j* may include at least two slots 38*a* and aperture 44 and lower intermediate panel 34*f* may include projections 36. Lower rear panel 34*j* is interlockingly connected to lower intermediate panel 34*f* by engaging projections 36 of lower intermediate panel 34*f* into slots 38*a* of lower rear panel 34*j*. Fastener 46 may be inserted through aperture 44 in lower rear panel 34*j* and into connector fastener hole 43 of push-in connector element 42 disposed in lower intermediate panel 34*f*. Lower front panel 34*a* may include projections 36, slot 38*a*, and aperture 44 and lower rear panel 34*j* may include projection 36, slots 38*a*, and aperture 44. Lower rear panel 34*j* is interlockingly connected to lower front panel 34*a* by engaging projections 36 of lower front panel 34*a* with slots 38*a* of lower rear panel 34*j* and by engaging projection 36 of lower rear panel 34*j* with slot 38*a* of lower front panel 34*a*. Fastener 46 may be inserted through aperture 44 in lower rear panel 34*j* and into connector fastener hole 43 in push-in connector element 42 disposed in lower front panel 34*a*. Similarly, fastener 46 may be inserted through aperture 44 in lower front panel 34*a* and into connector fastener hole 43 (not shown) in push-in connector element 42 disposed in lower rear panel 34*j*.

Figure 13:
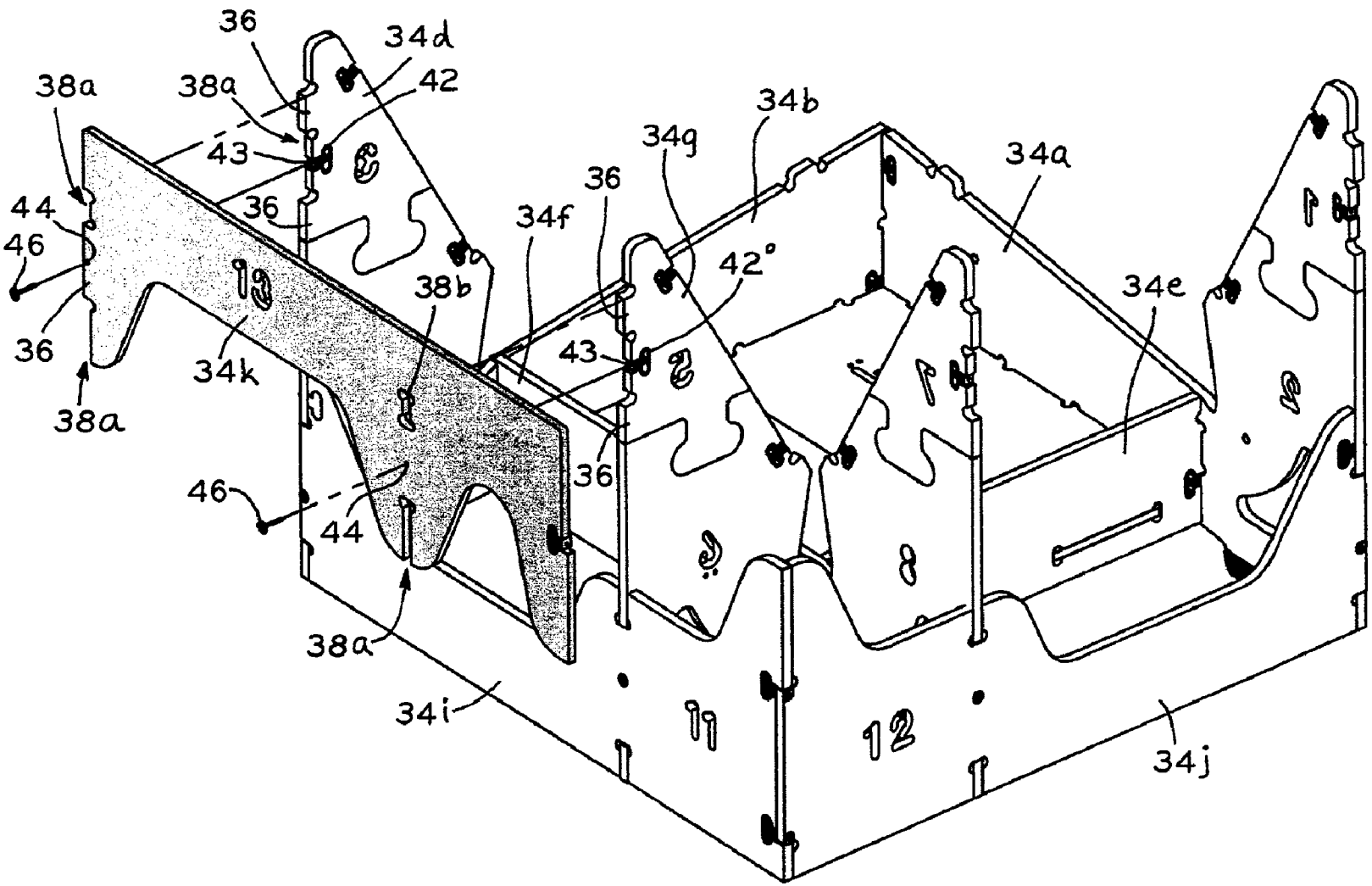

Referring to FIG. 13, the next step of the assembly process involves interlocking one of the upper rear panels to the remainder of the partially assembled frame. Upper front panel 34*d* may include projections 36 and slot 38*a* and upper rear panel 34*k* may include projection 36, slots 38*a*, and aperture 44. Upper rear panel 34*k* is interlockingly connected to upper front panel 34*d* by engaging projections 36 of upper front panel 34*d* with slots 38*a* of upper rear panel 34*k* and by engaging projection 36 of upper rear panel 34*k* with slot 38*a* of upper front panel 34*d*. Fastener 46 may be inserted through aperture 44 in upper rear panel 34*k* and into connector fastener hole 43 in push-in connector element 42 disposed in upper front panel 34*d*. Upper intermediate panel 34*g* may include projections 36 and upper rear panel 34*k* may include slot 38*a*, aperture 38*b*, and aperture 44. Upper rear panel 34*k* is interlockingly connected to upper intermediate panel 34*g* by engaging projections 36 of upper intermediate panel 34*g* with slot 38*a* and aperture 38*b* of upper rear panel 34*k*. Fastener 46 may be inserted through aperture 44 in upper rear panel 34*k* and into connector fastener hole 43 in push-in connector element 42 disposed in upper intermediate panel 34*g*.

Figure 14:
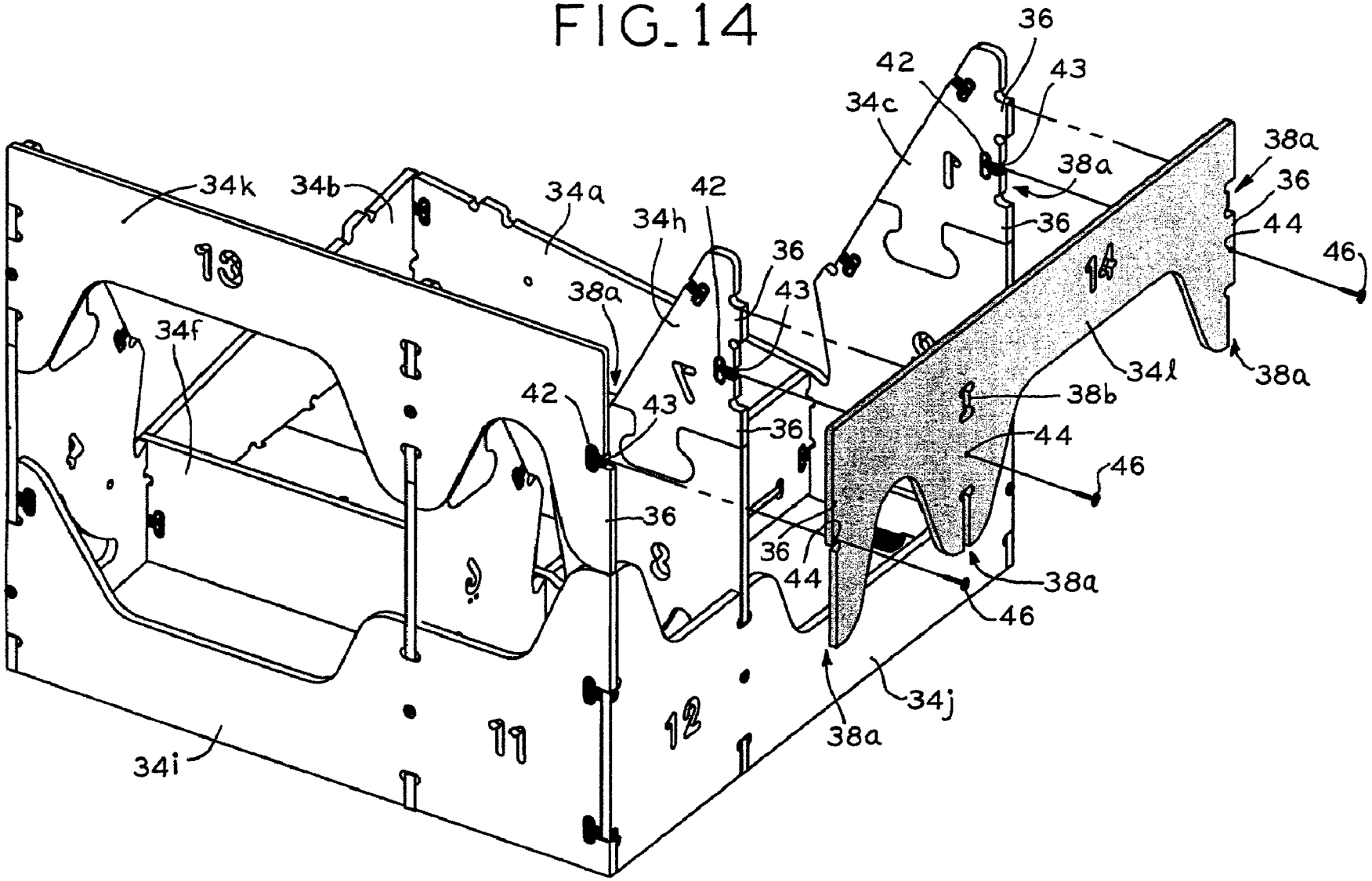

Referring to FIG. 14, the next step of the assembly process involves interlocking the other upper rear panel to the remainder of the partially assembled frame. Upper front panel 34*c* may include projections 36 and slot 38*a* and upper rear panel 34*l* may include projection 36, slots 38*a*, and aperture 44. Upper rear panel 34*l* is interlockingly connected to upper front panel 34*c* by engaging projections 36 of upper front panel 34*c* with slots 38*a* of upper rear panel 34*l* and by engaging projection 36 of upper rear panel 34*l* with slot 38*a* of upper front panel 34*c*. Fastener 46 may be inserted through aperture 44 in upper rear panel 34*l* and into connector fastener hole 43 in push-in connector element 42 disposed in upper front panel 34*c*. Upper intermediate panel 34*h* may include projections 36 and upper rear panel 34*l* may include slot 38*a*, aperture 38*b*, and aperture 44. Upper rear panel 34*l* is interlockingly connected to upper intermediate panel 34*h* by engaging projections 36 of upper intermediate panel 34*h* with slot 38*a* and aperture 38*b* of upper rear panel 34*l*. Fastener 46 may be inserted through aperture 44 in upper rear panel 34*l* and into connector fastener hole 43 in push-in connector element 42 disposed in upper intermediate panel 34*h*. Upper rear panel 34*k* may include slot 38*a* and projection 36 and upper rear panel 34*l* may include projection 36, slot 38*a*, and aperture 44. Upper rear panel 34*l* is interlockingly connected to upper rear panel 34*k* by engaging projection 36 of upper rear panel 34*k* with slot 38*a* of upper rear panel 34*l* and by engaging projection 36 of upper rear panel 34*l* with slot 38*a* of upper rear panel 34*k*. Fastener 46 may be inserted through aperture 44 in upper rear panel 34*l* and into connector fastener hole 43 in push-in connector element 42 disposed in upper rear panel 34*k*.

Figure 15:
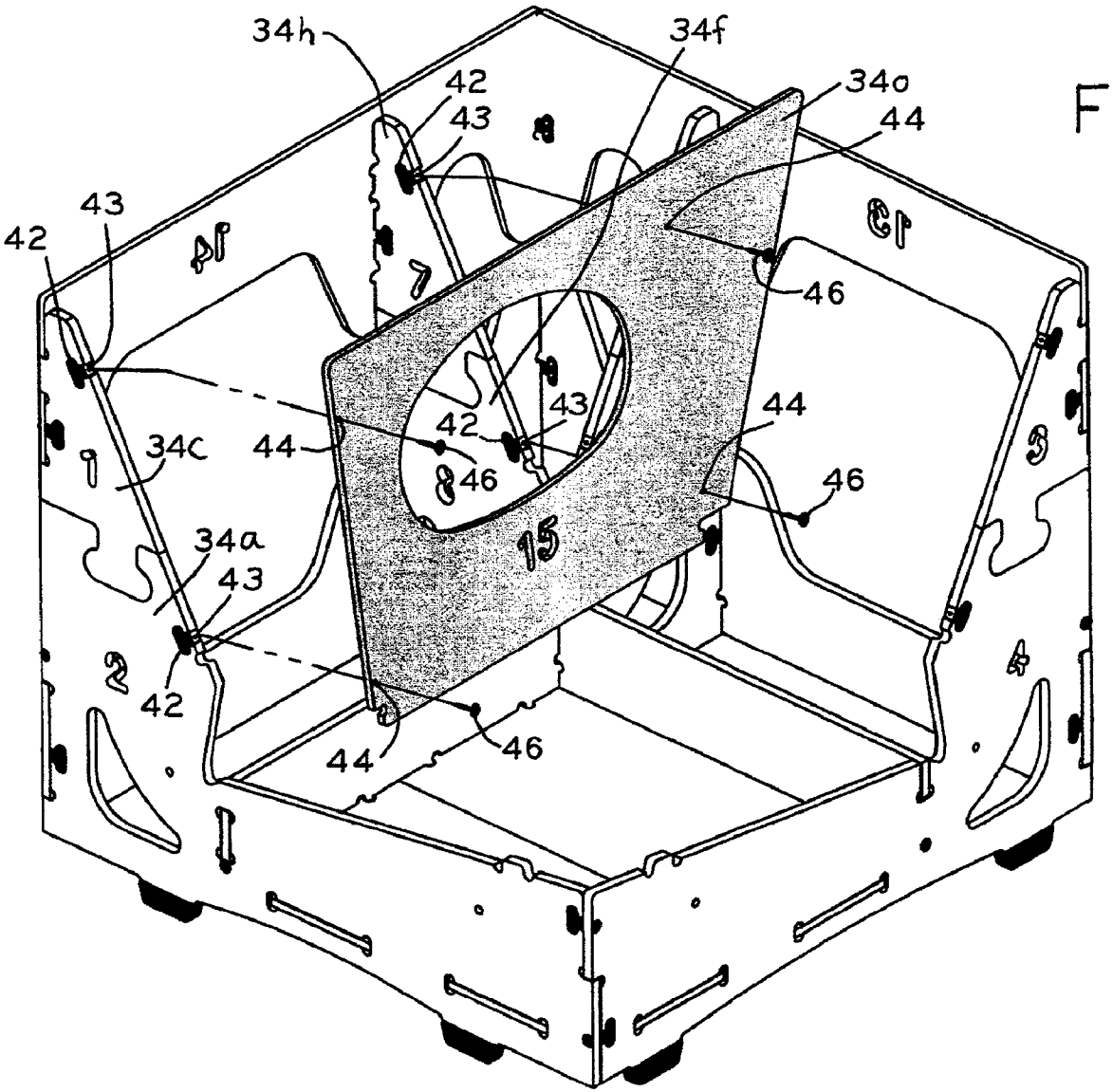

Referring to FIG. 15, the next step of the assembly process involves interlocking one of the backrest panels to the remainder of the partially assembled frame. Backrest panel 34*o* may include four apertures 44. Backrest panel 34*o* is interlockingly connected to upper front panel 34*c*, lower front panel 34*a*, lower intermediate panel 34*f*, and upper intermediate panel 34*h*. Fasteners 46 may be inserted through apertures 44 in backrest panel 34*o* and into connector fastener holes 43 in push-in connector elements 42 disposed in upper front panel 34*c*, lower front panel 34*a*, lower intermediate panel 34*f*, and upper intermediate panel 34*h*. Backrest panel 34*o* provides a backrest for a user as well as a back support for back cushion 62 (FIG. 1).

Figure 16:
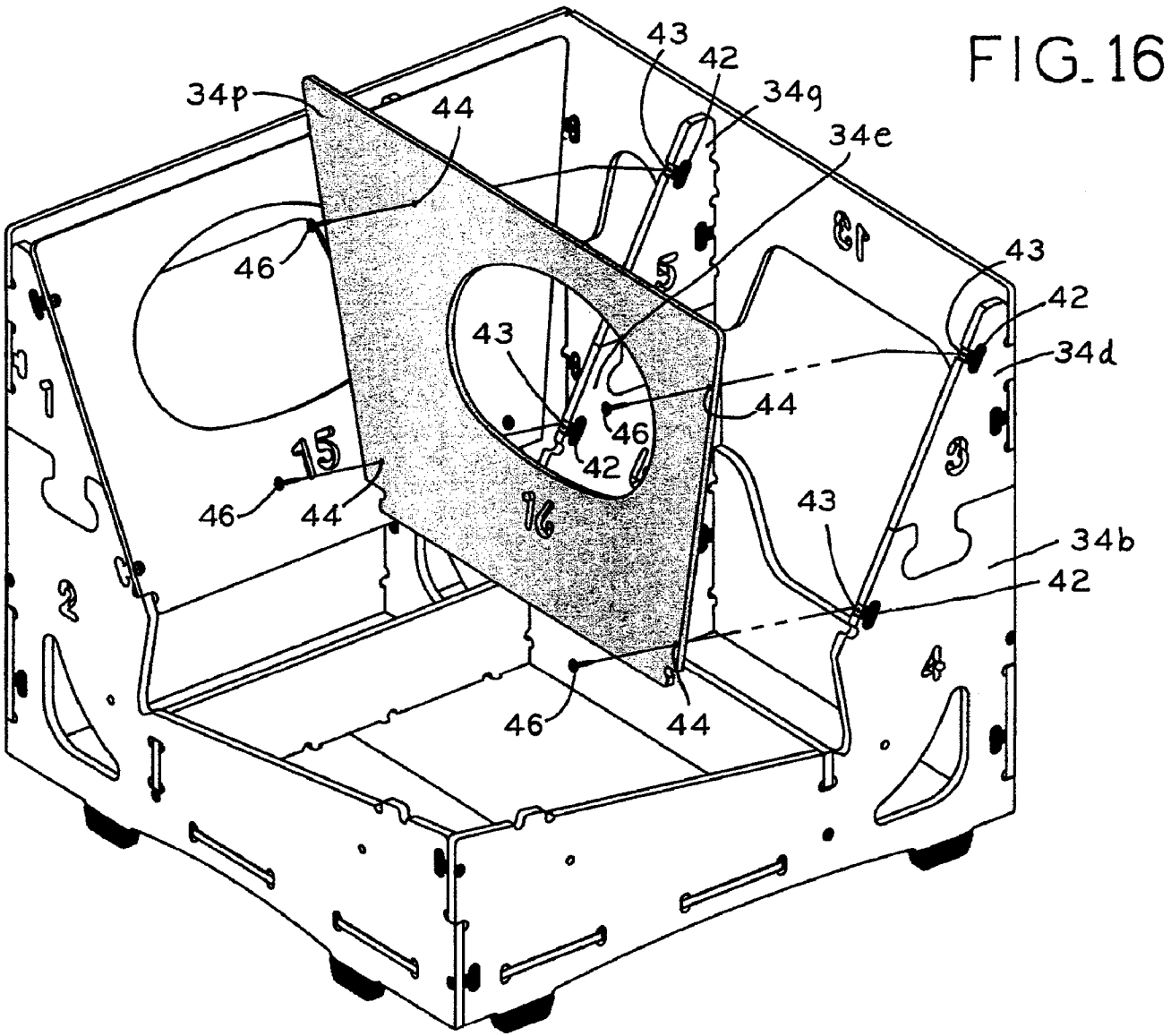

Referring to FIG. 16, the next step of the assembly process involves interlocking the other of the backrest panels to the remainder of the partially assembled frame. Backrest panel 34*p* may include four apertures 44. Backrest panel 34*p* is interlockingly connected to upper front panel 34*d*, lower front panel 34*b*, lower intermediate panel 34*e*, and upper intermediate panel 34*g*. Fasteners 46 may be inserted through apertures 44 in backrest panel 34*p* and into connector fastener holes 43 in push-in connector elements 42 disposed in upper front panel 34*d*, lower front panel 34*b*, lower intermediate panel 34*e*, and upper intermediate panel 34*g*. Backrest panel 34*p* provides a backrest for a user as well as a back support for back cushion 62 (FIG. 1).

Figure 17B:
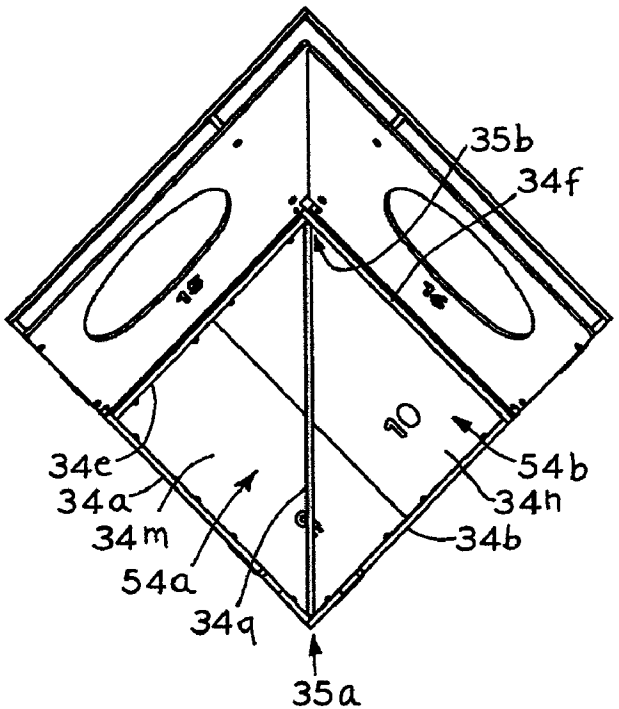
FIG. 17B is a top view of the portion of the frame of FIG. 17A.
Figure 17A:
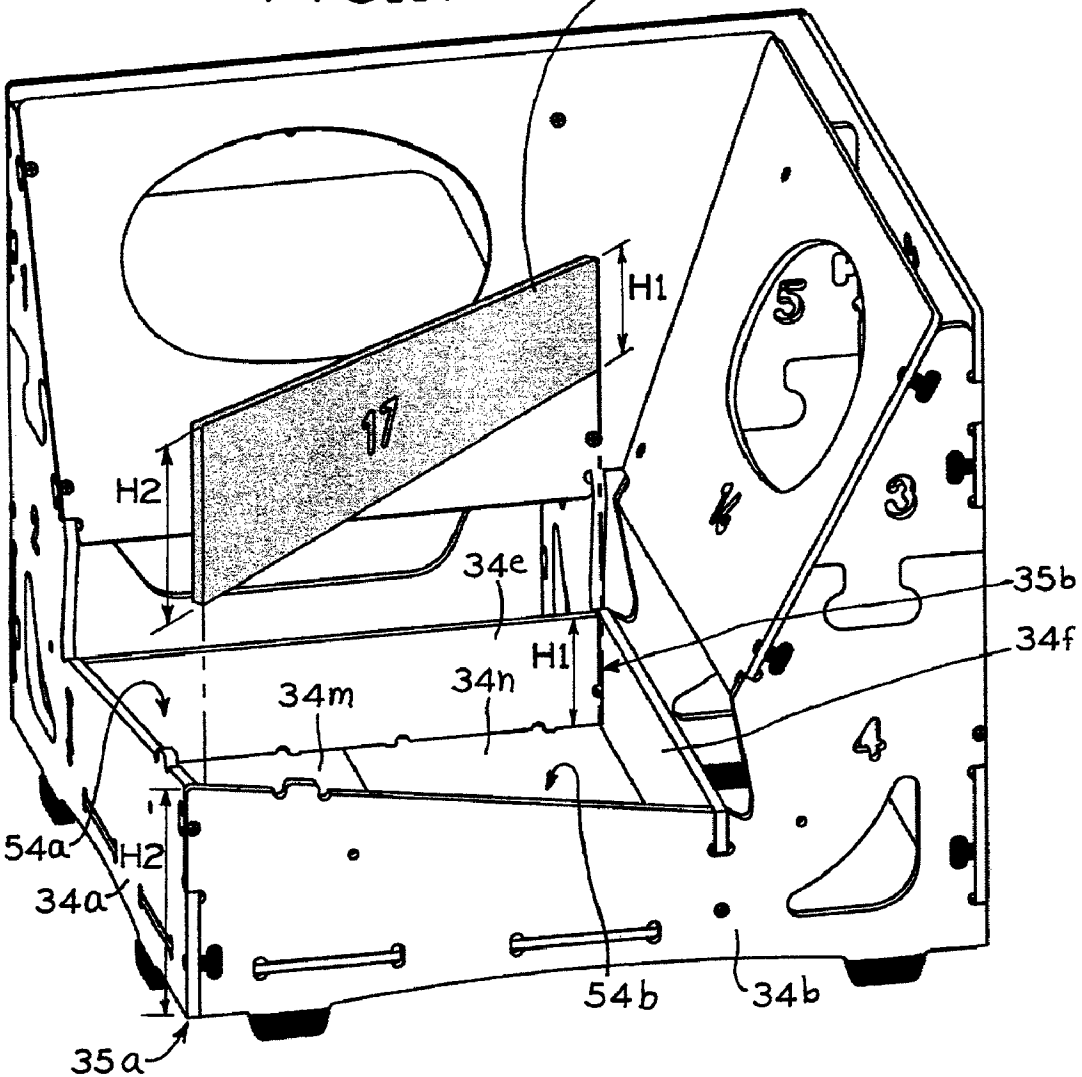

Referring to FIG. 17A, the next step of the assembly process involves assembling a support member for supporting at least a portion of the seat of the frame. The intersection of lower intermediate panels 34*e*, 34*f* forms rear junction 35*b* toward the rear of frame 32 and the intersection of lower front panels 34*a*, 34*b* forms front junction 35*a* toward the front of frame 32. Support panel 34*q* may be positioned in frame 32 to extend from rear junction 35*b* to front junction 35*a*. Support panel 34*q* may also include a generally tapered top edge, i.e., height H1 of support panel 34*q* matches height H1 of lower intermediate panels 34*e*, 34*f* at rear junction 35*b* and height H2 of support panel 34*q* matches height H2 of lower front panels 34*a*, 34*b* at front junction 35*a*. In an exemplary embodiment, height H2 of lower front panels 34*a*, 34*b* at front junction 35*a* may be greater than height H1 of lower intermediate panels 34*e*, 34*f* at rear junction 35*b*. Thus, support panel 34*q* defines a seat rise from the rear of frame 32 toward the front of frame 32. Referring to FIGS. 17A and 17B, support panel 34*q* also at least partially defines two separate and distinct storage compartments 54*a*, 54*b* within frame 32.

Figure 18:
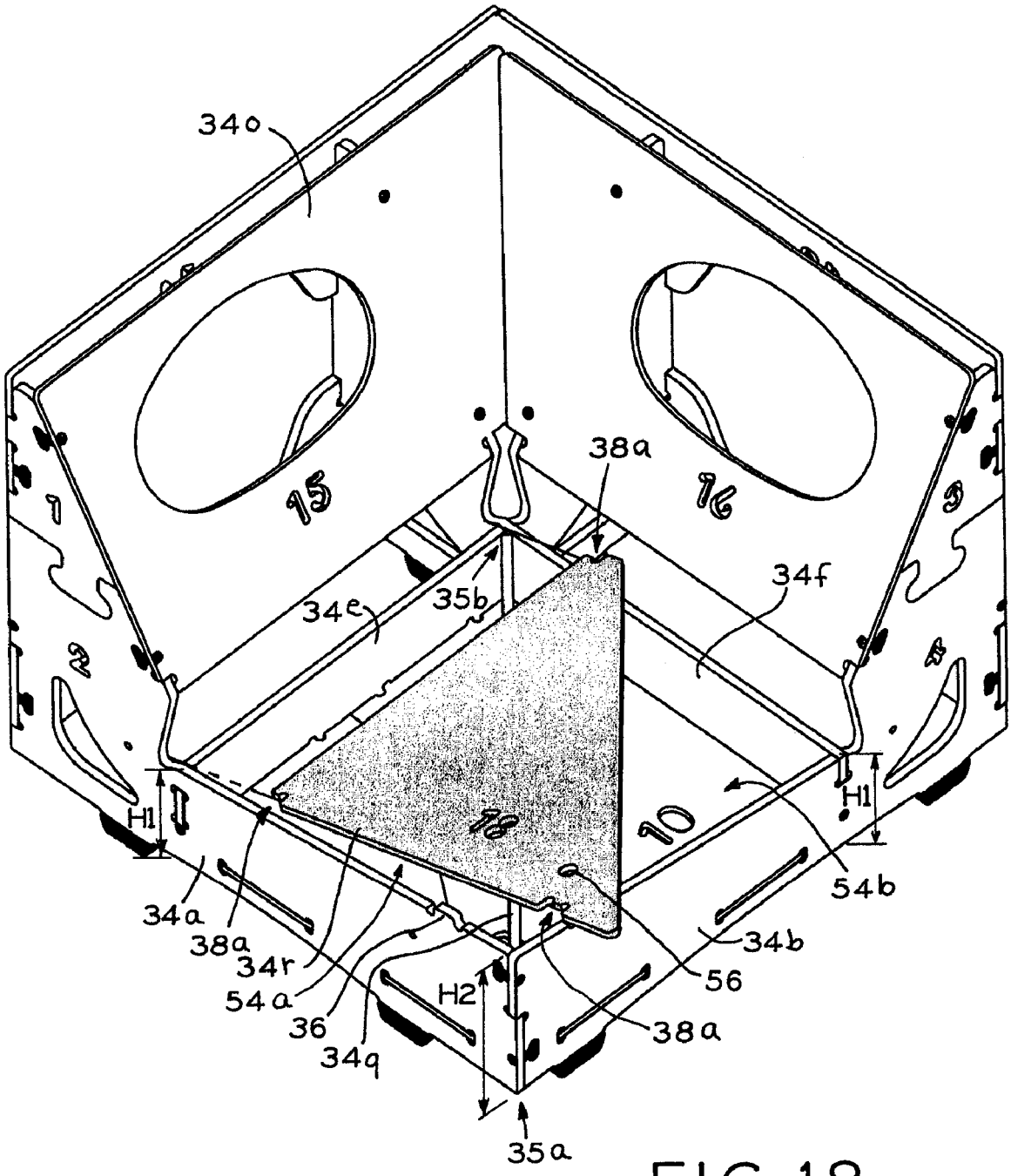

Referring to FIG. 18, the next step of the assembly process involves assembling one of the seat panels to the remainder of the partially assembled frame. Seat panel 34*r* may include slots 38*a* and handle aperture 56 and lower front panel 34*a* may include projection 36. Seat panel 34*r* is interlockingly connected to lower front panel 34*a* and lower intermediate panel 34*f* by engaging projection 36 of lower front panel 34*a* with slot 38*a* of seat panel 34*r* and engaging the remaining slots 38*a* of seat panel 34*r* with more rearward portions of lower front panel 34*a* and lower intermediate panel 34*f*, i.e., proximate the attachment of backrest panel 34*o* thereto. Handle aperture 56 may be provided for a user of article of furniture 30 to easily lift seat panel 34*r* to access storage compartment 54*a*.

Seat panel 34*r* may be generally triangularly-shaped and rests upon the upper edges of lower front panel 34*a*, lower intermediate panel 34*e*, and support panel 34*q*, which together are disposed in the same plane which is inclined in accordance with a seat rise, as described below. When positioned on frame 32, seat panel 34*r* generally rises from the rear of frame 32 toward the front of frame 32 due to the increasing height of lower front panel 34*a* from the rear toward front junction 35*a* of frame 32 and due to the increasing height of support panel 34*q* from rear junction 35*b* toward front junction 35*a* of frame 32, i.e., height H2 defined by lower front panel 34*a* and support panel 34*q* toward front junction 35*a* of frame 32 is greater than height H1 defined by lower front panel 34*a*, support panel 34*q*, and lower intermediate panel 34*e* toward rear junction 35*b* of frame 32. Seat panel 34*r* may define a first plane.

Referring again to FIG. 3, the next step of the assembly process involves assembling the other seat panel to the remainder of the partially assembled frame. Seat panel 34*s* may include slots 38*a* and handle aperture 56 and lower front panel 34*b* may include projection 36. Seat panel 34*s* is interlockingly connected to lower front panel 34*b* and lower intermediate panel 34*e* by engaging projection 36 of lower front panel 34*b* with slot 38*a* of seat panel 34*s* and engaging the remaining slots 38*a* of seat panel 34*s* with more rearward portions of lower front panel 34*b* and lower intermediate panel 34*e*, i.e., proximate the attachment of backrest panel 34*p* thereto. Handle aperture 56 may be provided for a user of article of furniture 30 to easily lift seat panel 34*s* to access storage compartment 54*b*. Seat panels 34*r*, 34*s* provide a seating surface and a support for seat cushion 60 (FIG. 1).

Seat panel 34*s* may be generally triangularly-shaped and rests upon the upper edges of lower front panel 34*b*, lower intermediate panel 34*f*, and support panel 34*q*, which together are disposed in the same plane which is inclined in accordance with a seat rise, as described below. When positioned on frame 32, seat panel 34*s* generally rises from the rear of frame 32 toward the front of frame 32 due to the increasing height of lower front panel 34*b* from the rear toward front junction 35*a* of frame 32 and due to the increasing height of support panel 34*q* from rear junction 35*b* toward front junction 35*a* of frame 32, i.e., height H2 defined by lower front panel 34*b* and support panel 34*q* toward front junction 35*a* of frame 32 is greater than height H1 defined by lower front panel 34*b*, lower intermediate panel 34*f*, and support panel 34*q* toward rear junction 35*b* of frame 32. In an exemplary embodiment, seat panel 34*s* may define a second plane which diverges from and is non-coplanar with the first plane defined by seat panel 34*r*.

Figure 2:
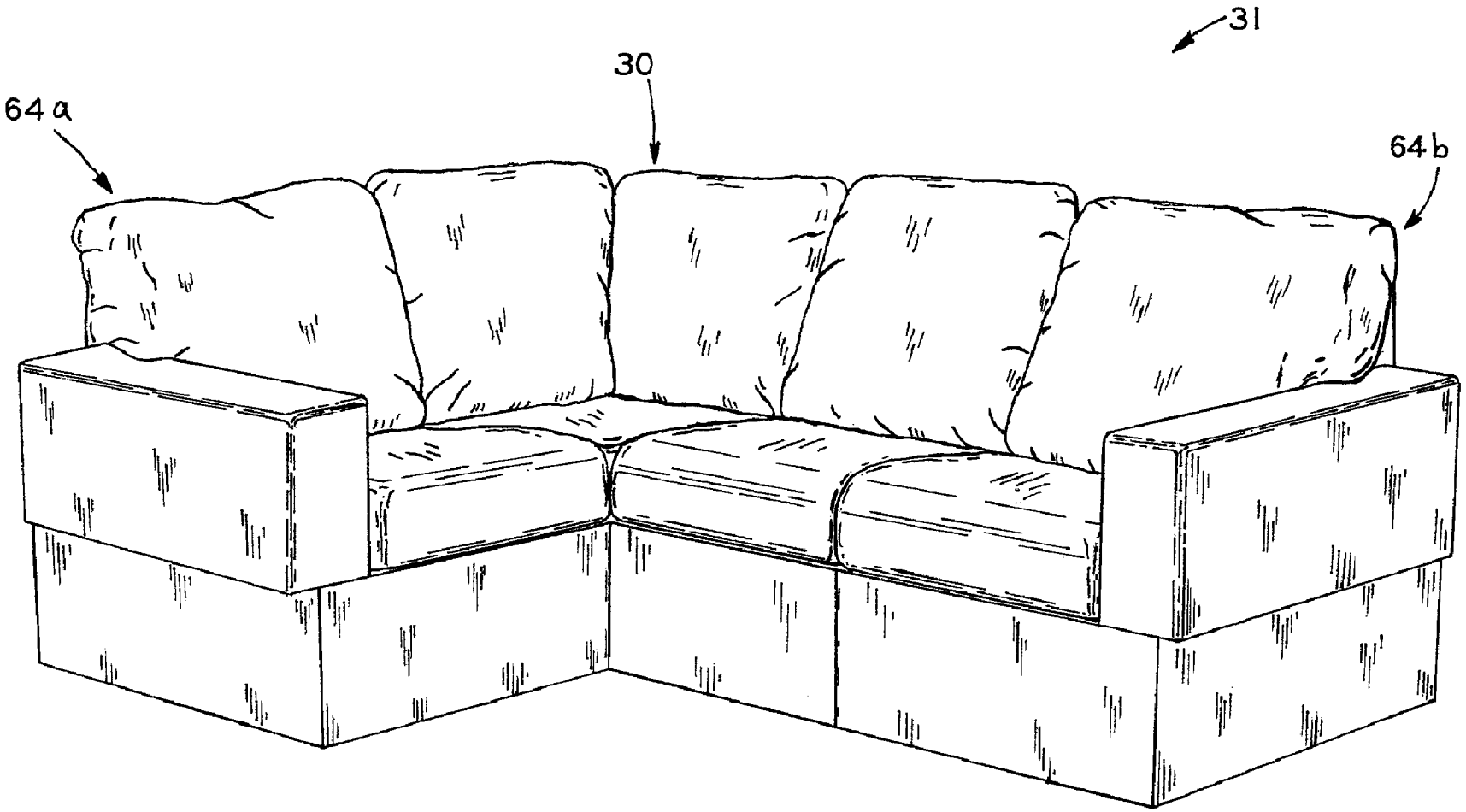
FIG. 2 is a perspective view of a sectional sofa furniture unit incorporating the sectional corner unit of FIG. 1.

The final steps of construction for article of furniture 30 of FIG. 1 are described in detail in the above-incorporated U.S. Pat. No. 6,568,058. Fabric upholstery covers are draped over frame 32 and secured thereto via hook-and-loop fasteners, for example. Fabric covers are also designed to fit over foam padding elements or pillows made for the various cushions of article of furniture 30. For example, back cushions 62 are constructed using a fabric cover fitted over a pillow. In contrast, for example, seat cushion 60 may be constructed using a fabric cover fitted over a foam pad. The cushions are then placed on upholstered frame 32 in an arrangement, for example, as shown in FIGS. 1 and 2.

Although described above in a particular order of assembly, frame members 34 and other associated portions of frame 32 may be assembled in a different order than described herein. For example, lower intermediate panel 34*e* and lower intermediate panel 34*f* could be assembled together prior to assembling either lower front panel 34*a* or lower front panel 34*b* to the lower intermediate panels.

Frame 32 may be joined with other sectional units 64*a*, 64*b* of sectional sofa unit 31 via a plurality of connector bolts (not shown) which extend through connector bolt apertures 66 (FIG. 3) in lower front panels 34*a*, 34*b* and into similar connector bolt apertures (not shown) in each sectional unit 64*a*, 64*b*.

Each of the above-described planar frame members are of a suitable size so they may be packaged for non-particularized parcel delivery service, as discussed above. The ease of transportation of the shipping packages by merchants or carriers advantageously reduces shipping costs and/or labor. Further, the smaller frame members advantageously allow for compact packaging and gives consumers the option of either receiving home delivery of the furniture by a parcel delivery service, or easily taking the furniture home from a retail location at the time of sale in their own vehicles, rather than requiring them to wait for particularized delivery by the retailer or another carrier.

The number, size and shape of frame members discussed above will vary depending on the article of furniture to be produced. The frame members may be formed of any suitable supporting material, such as pre-finished plywood, oriented strand board ("OSB"), medium density fiberboard ("MDF"), laminated veneer lumber ("LVL"), solid wood boards, laminated particle board, pre-formed plastic or metal pieces, other varieties of fiber board or strand board, or structural cardboard of honeycombed paperboard. Furthermore, fasteners may not be required for securing the frame members. For example, the interconnection of the frame assembly may instead consist of interlocking frame members which may include slots for mutual engagement, or adhesives may be used to join the frame members. The frame members may be pre-finished or may consist of unfinished pieces that the consumers may stain and varnish or paint to suit their individual tastes.

In an exemplary embodiment, the frame members discussed above may be planar sheets or panels, and may be made of medium density fiberboard ("MDF"). MDF is made from fibers of various types of wood which are refined and pressed to form lightweight fiberboard sheets having a strong outer surface which can be finished with most commercial finishing materials such as sealer, varnish, or paint. MDF is available in sheets which may range from ⅜" thick to 1½" thick, for example, and the length and width of MDF sheets may vary widely depending upon the supplier. One such MDF material is ½" GP Superior, available from Georgia-Pacific Co., and manufactured at their Sault Ste. Marie plant in Ontario, Canada. However, MDF is generally widely available from many commercial suppliers. Frame members 34 may be cut from large sheets of MDF using widely-available machinery such as computer-controlled cutting saws and routers, for example.

The construction and size of the various components of the present disclosure advantageously provide to consumers ready-to-assemble upholstered furniture of high quality and low cost. For shipment, the article of furniture may be packaged such that the frame members, connector elements, and fasteners are packaged in a first container, the padding elements are packaged in a second container, and the upholstery covers are packaged in a third container. Each one of the first, second, and third containers may weigh about 70 pounds or less to allow them to be delivered directly to the home of a consumer by a parcel delivery service.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A corner unit for an article of sectional furniture, comprising:

a seat portion having first and second front edges and first and second rear edges;

a backrest portion;

at least a first vertical internal frame member and a second vertical internal frame member disposed substantially perpendicular to each other, said internal frame members vertically overlapping and interlocked with one another, said first and second vertical internal frame members each including upper edges, said upper edges respectively defining said first and second rear edges of said seat portion that are perpendicular to one another;

at least a first vertical sectional facing frame member and a second vertical sectional facing frame member, said sectional facing frame members disposed perpendicular to one another and respectively connected to said first internal frame member and said second internal frame member, said first and second vertical sectional facing frame members each including upper edges, said upper edges respectively defining said first and second front edges of said seat portion that are perpendicular to one another and which each slope downwardly toward respective said rear edges of said seat portion; and each of said internal frame members and said sectional facing frame members at least partially defining both the seat portion and the backrest portion of said corner unit.

2. The corner unit of claim 1, wherein said first internal frame member and said second internal frame member are substantially planar.

3. The corner unit of claim 1, wherein one of said sectional facing frame members is disposed substantially perpendicular to said first internal frame member and another of said sectional facing frame members is disposed substantially perpendicular to said second internal frame member.

4. The corner unit of claim 1, wherein said sectional facing frame members are interlocked with respective said first internal frame member and said second internal frame member, said first sectional facing frame member interlocked with said second sectional facing frame member.

5. The corner unit of claim 1, wherein said seat portion defines a plurality of storage compartments therein, said seat portion including a cover member having at least two diverging planar surfaces.

6. The corner unit of claim 1, further comprising a plurality of push-in connector elements and associated fasteners connecting at least some of said frame members.

7. A corner unit for an article of sectional furniture, comprising:

a backrest portion;

a seating portion having a pair of perpendicular front edges and a pair of perpendicular rear edges; and at least a first internal frame member and a second internal frame member each defining at least a portion of said seating portion and said backrest portion, said first internal frame member and said second internal frame member disposed in overlapping relationship and substantially perpendicular with respect to each other, said first and second internal frame members connected to one another at an interlock joint defining an intersection between said rear edges of said seating portion; and first and second backrest panels respectively attached to said first and second internal frame members, said first and second backrest panels disposed perpendicular to one another.

8. The corner unit of claim 7, wherein said first internal frame member and said second internal frame member are substantially planar.

9. The corner unit of claim 7, further comprising at least a first sectional facing frame member and a second sectional facing frame member, said sectional facing frame members respectively interlocked with said first internal frame member and said second internal frame member.

10. The corner unit of claim 9, wherein one of said sectional facing sides is disposed substantially perpendicular to said first internal frame member and another of said sectional facing sides is disposed substantially perpendicular to said second internal frame member.

11. The corner unit of claim 9, wherein said first sectional facing frame member is interlocked with said second sectional facing frame member.

12. The corner unit of claim 7, wherein said first internal frame member and said second internal frame member include interlocking portions.

13. The corner unit of claim 7, further comprising a seat portion, said seat portion defining a plurality of storage compartments therein, said seat portion including a cover member having at least two diverging planar surfaces.

14. The corner unit of claim 7, further comprising a plurality of push-in connector elements and associated fasteners connecting at least some of said frame members.

15. The corner unit of claim 7, wherein said first and second backrest panels each include upper edges and lower edges, said upper edges having a first width and said lower edges having a second width, said first width greater than said second width.

16. A corner unit for an article of sectional furniture, the corner unit including a seat portion and a backrest portion, comprising:

a storage area defined at least in part by a first vertical internal frame member and a second vertical internal frame member having upper edges, said internal frame members disposed in perpendicular overlapping relationship and each at least partially defining said seat portion and said backrest portion; and a cover assembly supported by said upper edges, said cover assembly defining at least two diverging planar seating surfaces, and including at least two liftable cover frame members.

17. The corner unit of claim 16, wherein said upper edges define a seat incline.

18. The corner unit of claim 17, wherein said seat incline is defined by a first height of said interconnected frame members proximate the sectional facing portion and a second height of said interconnected frame members proximate the backrest portion, said first height greater than said second height.

19. A corner unit for an article of sectional furniture, the corner unit including a seat portion and a backrest portion, comprising:

a storage area defined at least in part by a first vertical internal frame member and a second vertical internal frame member having upper edges, said internal frame members disposed in perpendicular overlapping relationship and each at least partially defining said seat portion and said backrest portion, said plurality of interconnected frame members further including a center divider frame member in said storage area; and a cover assembly supported by said upper edges, said cover assembly defining at least two diverging planar seating surfaces.

20. The corner unit of claim 1, further comprising:

a first junction between said front edges of said seat portion, said first junction defined by said first and second vertical sectional facing frame members;

a second junction between said rear edges of said seat portion, said second junction defined by said first and second vertical internal frame members; and a support panel extending between said first and second junctions, said support panel having an upper edge sloping downwardly toward said second junction.

* * * * *